US006092999A

United States Patent [19]

Lilie et al.

[11] Patent Number: 6,092,999

[45] Date of Patent: Jul. 25, 2000

[54] RECIPROCATING COMPRESSOR WITH A LINEAR MOTOR

[75] Inventors: Dietmar Erich Bernhard Lilie; Egidio Berwanger, both of Joinville-SC, Brazil

[73] Assignee: Empresa Brasileira de Compressores S/A.-Embraco, Joinville-SC, Brazil

[21] Appl. No.: 09/252,293

[22] Filed: Feb. 18, 1999

[30] Foreign Application Priority Data

Feb. 20, 1998 [BR] Brazil ..... 9802892

[51] Int. Cl.[7] ..... F04B 17/00

[52] U.S. Cl. ..... 417/415; 417/416; 417/417

[58] Field of Search ..... 417/415, 416, 417/417, 902

[56] References Cited

U.S. PATENT DOCUMENTS

| | | | |
|---|---|---|---|
| 3,937,600 | 2/1976 | White | 417/416 |
| 4,067,667 | 1/1978 | White | 417/418 |
| 4,360,087 | 11/1982 | Curwen | 188/379 |
| 4,781,546 | 11/1988 | Curwen | 417/417 |
| 5,146,124 | 9/1992 | Higham et al. | 310/17 |
| 5,201,641 | 4/1993 | Richer | 417/417 |
| 5,318,412 | 6/1994 | Laskaris et al. | 417/417 |
| 5,704,771 | 1/1998 | Fujisawa et al. | 417/417 |
| 5,715,693 | 2/1998 | Walt et al. | 62/198 |
| 5,772,410 | 6/1998 | Chang | 417/363 |

*Primary Examiner*—Teresa Walberg
*Assistant Examiner*—Vinod D. Patel
*Attorney, Agent, or Firm*—Darby & Darby

[57] ABSTRACT

A reciprocating compressor with a linear motor, comprising a hermetic housing (10), which lodges a cylinder (20), a piston (30); a rod (40), which is coupled to the piston (30) and which is axially displaceable by a linear motor (50); a first supporting means (70) and a second supporting means (80), which are elastically deformable and coupled to the housing (10) and, respectively, to the cylinder (20) and to the rod (40), and which are electromagnetically displaceable in opposite directions, in order to provoke the axial displacement of the cylinder (20) and of the piston-rod assembly (30, 40) between the upper and lower dead point positions.

14 Claims, 4 Drawing Sheets

RECIPROCATING COMPRESSOR WITH A LINEAR MOTOR

FIELD OF THE INVENTION

The present invention refers to a construction for a small reciprocating hermetic compressor, which is driven by a linear motor and which is particularly appliable in refrigeration systems.

BACKGROUND OF THE INVENTION

It is known from the prior art to use a linear motor in reciprocating hermetic compressors. The use of this type of motor in reciprocating hermetic compressors has some advantages in relation to the reciprocating or rotary hermetic compressors which use rotary motors.

In the constructions with linear motors, there is a reduction in the number of parts with relative movement, as compared to the conventional constructions of compressors with rotary motors, which results in gains in terms of dissipated power in the bearings. These constructions, therefore, have more reliability, less requirements in terms of dimensional tolerances of the transmission components and lower generation of potential excitations which cause noise.

However, due to the operational principle itself, the known constructions of reciprocating compressors with a linear motor have a higher vibration during operation, resulting from the non-balanceable components of the forces generated during transmission, which requires the use of suspension systems, such as those used in reciprocating compressors with rotary motors, or also more complex transmission mechanisms which insulate the vibration or does not generate said vibration. The use of suspensions requires a larger available space, resulting in a larger external volume than that usually needed in compressors with another type of motor, for example the rotary compressors with a rolling piston. The solution of using more complex mechanisms reduces the advantages related to the simplicity of the mechanism of a linear motor, resulting in cost increase and more complex manufacturing processes.

DISCLOSURE OF THE INVENTION

Thus, it is an objective of the present invention to provide a reciprocating compressor with a linear motor, which presents minimum vibration during operation, without needing constructions which use suspension or more complex transmission mechanisms, as it occurs in the known prior art constructions.

These and other objectives are achieved by a reciprocating compressor, comprising a hermetic housing, which lodges a cylinder, a piston reciprocating inside the cylinder and a rod, which is coupled to the piston and which is axially displaceable by a linear motor.

According to the invention, the compressor further comprises: a first supporting means, connecting the cylinder to the housing, and a second supporting means, connecting the rod to the housing, said first and second supporting means being elastically deformable, in order to allow the axial displacement of the cylinder and of the piston-rod assembly between a lower dead point position and an upper dead point position of the piston; a first annular motor portion and a second annular motor portion, which are mutually coaxial and coupled to the cylinder and to the rod, respectively, and which are axially and electromagnetically displaceable in opposite directions, in order to provoke the axial displacement of the cylinder and of the piston-rod assembly between the upper and lower dead point positions.

BRIEF DESCRIPTION OF THE DRAWINGS

The invention will be described below, with reference to the attached drawings, in which.

BEST MODE OF CARRYING OUT THE INVENTION

Figure 1:
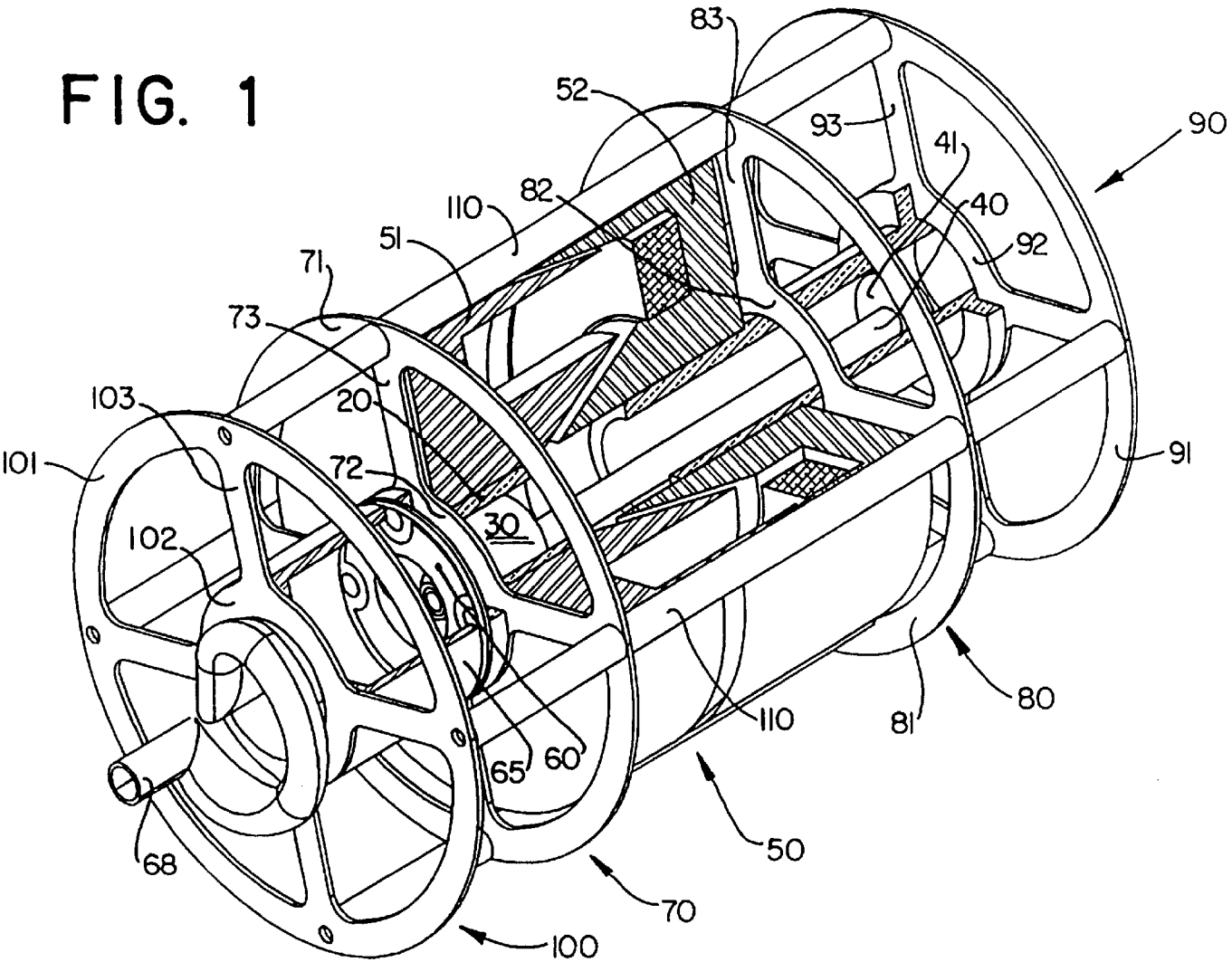
FIG. 1 shows, schematically and in a perspective view, part of a reciprocating compressor with a linear motor constructed according to the present invention.

According to the figures, the reciprocating hermetic compressor of the present invention comprises a hermetic housing 10, within which are lodged a cylinder 20, a piston 30 reciprocating inside the cylinder 20 and a rod 40, which is coupled to the piston 30 and which is axially displaceable upon operation of a linear motor 50, to which it is operatively coupled. The cylinder 20 has an open end, through which passes the rod 40, and an opposite end, which is closed by a valve plate 60 provided with suction and discharge valves (not shown) and having any construction adequate to the contour of the cylinder 20. In the illustrated embodiment, the valve plate 60 has a circular contour, similar to the external circular contour of the cylinder 20.

Figure 4:
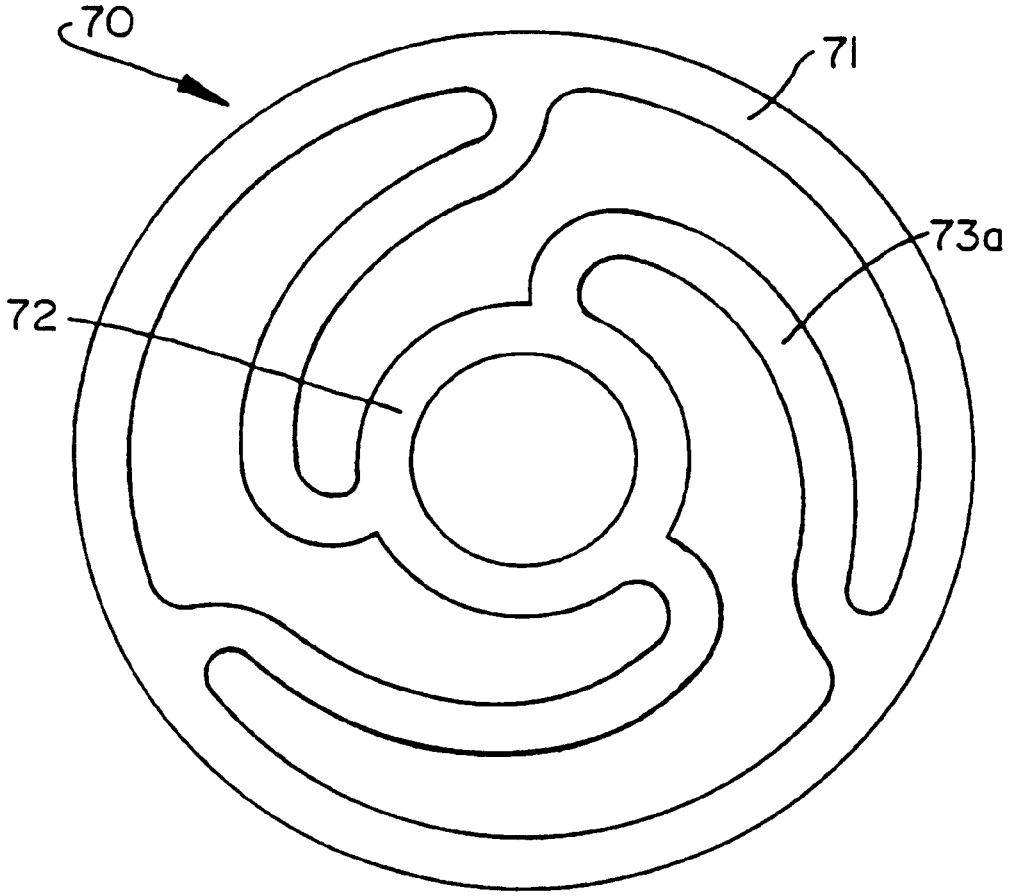
FIG. 4 illustrates a front elevational view of another embodiment for the supporting means.

The fixation of the cylinder 20 to the housing 10 is made through a first supporting means 70, which is transversely disposed in relation to the longitudinal axis of the cylinder 20 and which, in the illustrated embodiment, takes the form of a plate or blade of a metallic or synthetic material, whose contour is smaller than the internal contour of the cross-section of the housing 10 and which is formed by an external annular portion 71 and an internal annular portion 72, which is affixed to the cylinder 20 and incorporated to the external annular portion 71 by means of an intermediate portion defined by a plurality of rectilinear radial arms 73 or arcuated radial arms 73*a*, as illustrated in FIGS. 1 and 4.

The construction of this first supporting means 70 is made in order to provide the radial arms 73, 73*a* and, optionally, also the external annular portion 71 and internal annular portion 72 with enough flexibility to allow the internal annular portion 72, which carries the cylinder 20, to be axially displaced together with the latter, by an extension at minimum corresponding to half the total displacement of the piston 30 inside the cylinder 20.

The rod 40 has one end coupled to the piston 30 and the other end is internal and coupled to a rod base 41 which, in the illustrated embodiment, takes the form of a cylindrical tubular block, which is coaxial in relation to the cylinder 20 and axially spaced from the latter and which is affixed to the housing 10 through a second supporting means 80, similar to the first supporting means 70 and having an external annular portion 81 and an internal annular portion 82 affixed to the rod base 41 and incorporated to the external annular portion 81 by a plurality of radial arms 83, which may take the arcuated shape, as illustrated for the arms 73*a* of FIG. 4.

As it occurs with the first supporting means 70, the second supporting means 80 has its radial arms 83 flexible enough to allow the internal annular portion 82, which carries the rod base 41, to be axially displaced together with the latter, by an extension corresponding at minimum to half the complete displacement of the piston 30 inside the cylinder 20.

The above mentioned embodiment allows the cylinder 20 and the piston-rod assembly 30, 40 to be simultaneously and axially displaced in opposite directions, promoting the displacement of the piston inside the cylinder, by the rod being axially displaced.

In the illustrated embodiment, the rod 40 has its ends affixed to the piston and to the rod base, respectively, and has a length/diameter relationship high enough to give the rod a radial flexibility, which is able to absorb possible disalignments between the axis thereof and that of the cylinder during the movement of said parts, without occurring excessive bending.

Figure 2:
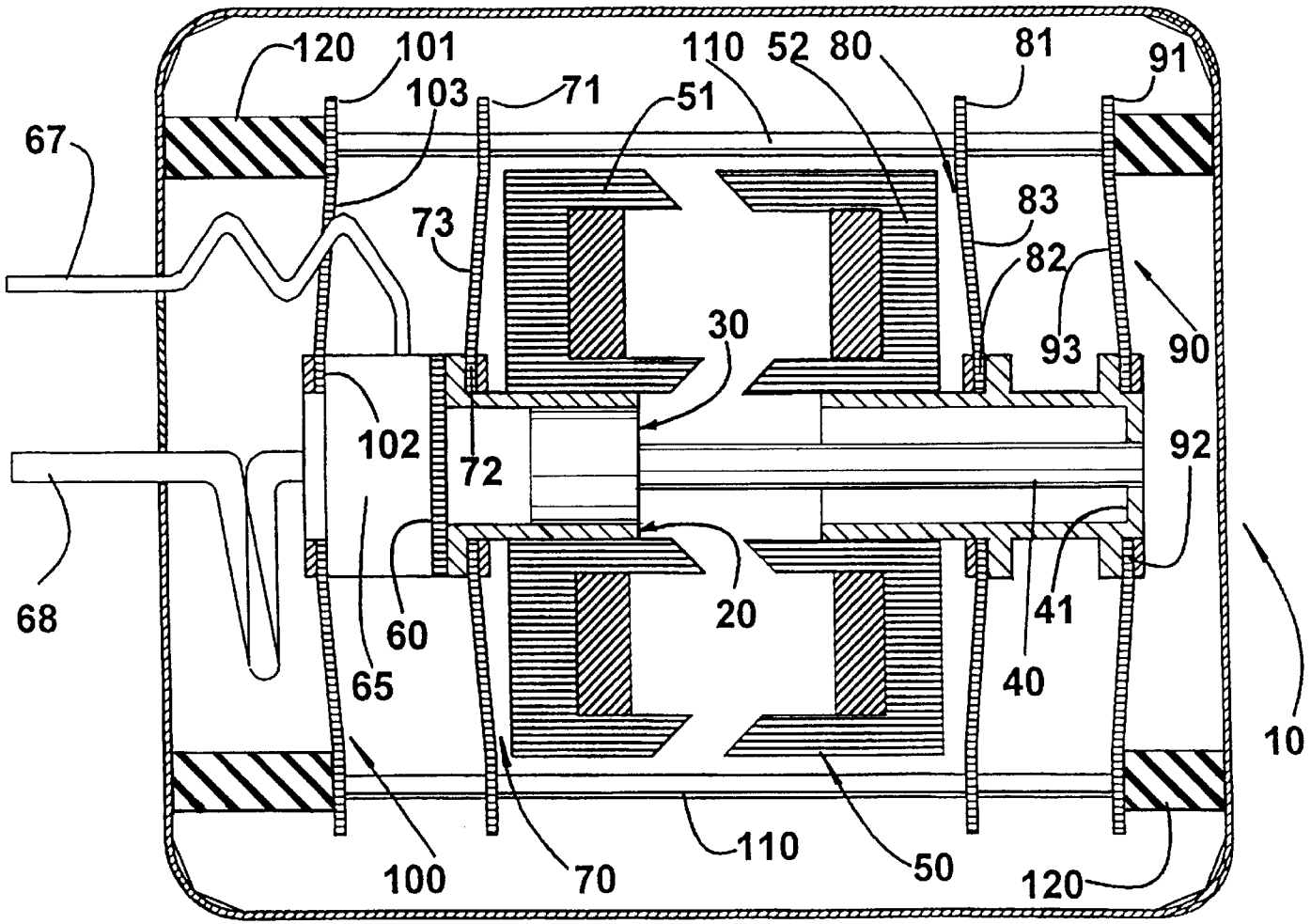
FIG. 2 shows, schematically, a longitudinal diametrical sectional view of the compressor, with the piston-rod assembly in the lower dead point position.
Figure 3:
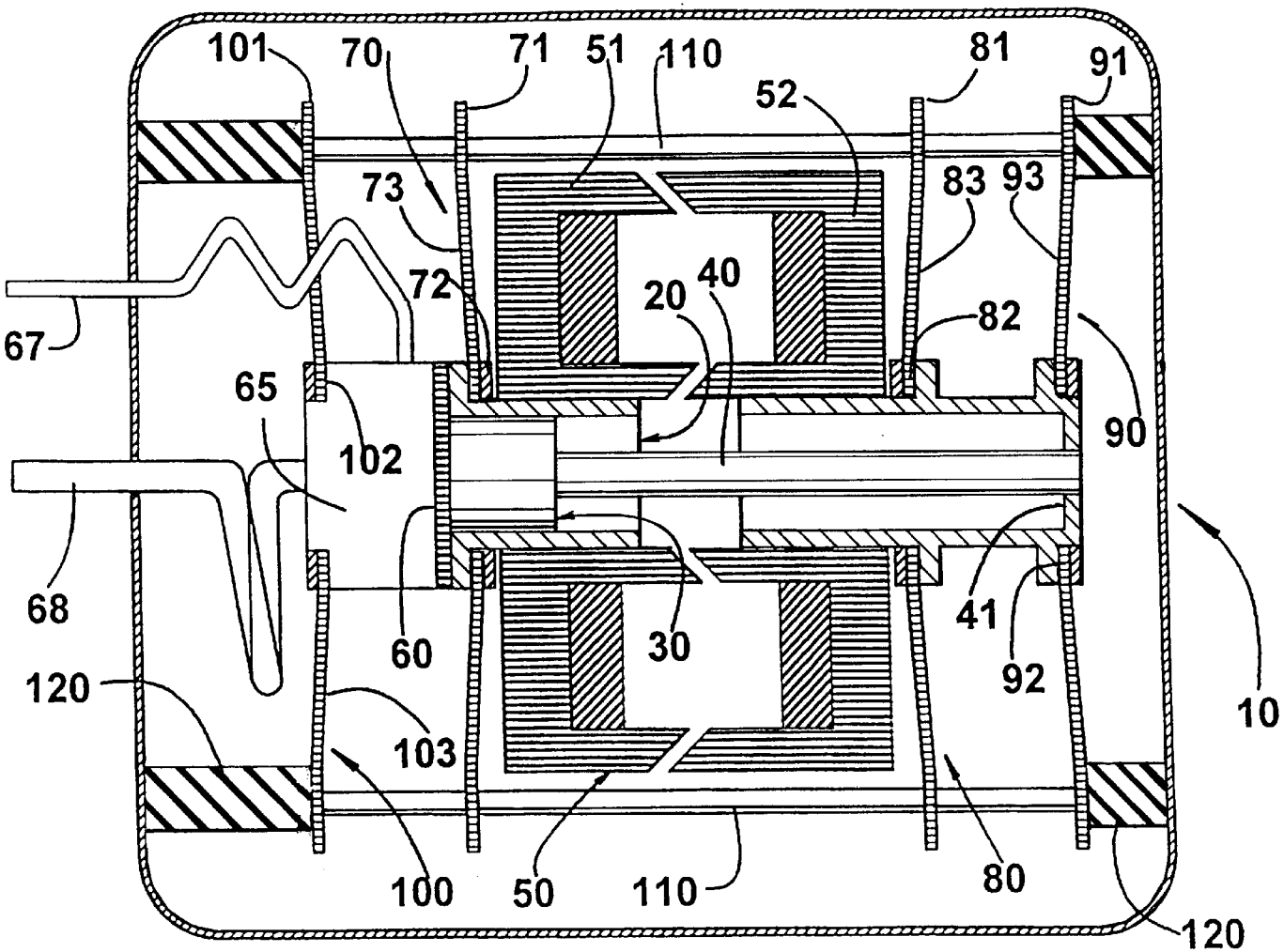
FIG. 3 is a similar view to that of FIG. 2, but illustrating the piston-rod assembly in the upper dead point position.

According to the present invention, the linear motor 50 comprises a first annular motor portion 51 and a second annular motor portion 52, said portions being axially aligned to each other and to the axes of the first and second supporting means 70, 80, said first and second motor portions 51, 52 being respectively affixed to the cylinder 20 and to the rod base 41, surrounding these compressor parts inside the housing 10. As illustrated in FIG. 2, the annular motor portions 51, 52 are kept axially spaced from each other by a maximum value when the piston 30 is found in the lower dead point position, which position may correspond to a condition of motor deenergization. This condition of mutual spacing may also be achieved and maintained by inverting the polarization of the magnetic field between the annular motor portions 51, 52, while said motor is kept energized. An axial distance of minimum value, and which may be substantially null, between the annular motor portions, is achieved when the linear motor 50 is conducted to an operative condition, in which the magnetic field causes the mutual attraction of said annular motor portions 51, 52. Each variation of the magnetic field between the first and the second annular motor portions 51, 52 causes a relative axial displacement between the cylinder 20 and the pistonrod assembly 30, 40, for spacing apart or approaching said parts to each other.

This construction in which the motor is external to the cylinder and to the rod allows to obtain an important reduction in the external volume of the hermetic compressor.

The condition of a minimum or null spacing between the annular motor portions corresponds to the upper dead point condition of the piston 30, or to the end of the compression stroke thereof. On the other hand, the condition of maximum spacing between both annular motor portions 51, 52 corresponds to the lower dead point condition of the piston 30, or to the end of the suction stroke thereof.

In a preferred construction, the masses of the assemblies in relative movement are equivalent, so that the resulting force of the vibratory forces existing during the operation of the compressor be minimized, preferably nullified, which permits the use of a rigid connection of the first and second supporting means 70, 80 with the hermetic housing 10, without occurring vibration externally to said housing, which is impracticable with the known linear motor constructions of the prior art. Moreover, the present invention allows the change of the natural frequencies of the housing to higher bands, due to the reduced external dimensions, which is advantageous in terms of noise.

In the illustrated construction, the rod base 41 is also coupled to the housing 10 by means of a third supporting means 90, whose construction is equal to that of the second supporting means 80 and has the same component parts 91, 92 and 93.

As illustrated, it is further provided a cylinder cover 65, with a usually tubular shape, which is affixed to the external face of the valve plate 60 and in whose inside is defined at least one discharge dampening chamber, to which is coupled a discharge tube 67. This cylinder cover 65 may also define a suction dampening chamber, which, in the present example, is directly and hermetically connected to a flexible suction inlet tube 68 and, through the latter, to a refrigerant gas duct of the refrigeration system to which the present compressor is associated.

In the illustrated embodiment, it is further provided a fourth supporting means 100, whose construction is equal to that of the other supporting means and has the same component parts 101, 102 and 103, the internal annular portion 102 carrying an end of the cylinder cover 65.

The supporting means 70, 80, 90 and 100 are affixed axially spaced from each other by a plurality of longitudinal rigid bars 110, which are mounted through the external annular portions 71, 81, 91 101 and which are angularly and mutually spaced from each other, the opposite ends of the bars 110 being affixed to rubber pads 120 provided between the end supporting means 90 and 100 and the housing 10. According to the drawings, the supporting means 70, 80, 90 and 100 have the external, internal and intermediate portions lying on the same plane transversal to the longitudinal axis of the cylinder 20. However, it should be understood that the external and internal portions of each supporting means may be disposed in mutually parallel planes.

The construction of the reciprocating compressor of the present invention results in a minimization of losses due to leakage and less load over the head portion of the piston, giving more reliability to the components of the compressor. This construction does not require anymore the use of lubricant oil in the compressor, which results in cost and reliability advantages, since the thermal or chemical degradation of the oil is a common cause of failure in the compressors, higher efficiency of thermal exchange of the refrigerant fluid, since the latter has no lubricant oil, thereby increasing the efficiency of the heat exchangers of the refrigerant system (evaporator and condenser) and of the refrigeration system as a whole, besides avoiding the partial clogging of the evaporator by the excess of oil therein, which normally reduces the efficiency of the refrigeration system.

What is claimed is:

1. A reciprocating compressor with a linear motor, comprising a hermetic housing (10), which lodges a cylinder (20), a piston (30) reciprocating inside the cylinder and a rod (40), which is coupled to the piston (30) and which is axially displaceable by a linear motor (50), characterized in that it further comprises: a first supporting means (70), connecting the cylinder (20) to the housing (10), and a second supporting means (80), connecting the rod (40) to the housing (10), said first and second supporting means (70, 80) being elastically deformable, in order to allow the axial displacement of the cylinder (20) and of the piston-rod assembly (30, 40) between a lower dead point position and an upper dead point position of the piston; a first annular motor portion (51) and a second annular motor portion (52), which are mutually coaxial and coupled to the cylinder (20) and to the rod (40), respectively, and which are axially and electromagnetically displaceable in opposite directions, in order to provoke the axial displacement of the cylinder (20) and of the piston-rod assembly (30, 40) between the upper and lower dead point positions.

2. A reciprocating compressor, as in claim 1, characterized in that the rod (40) has the end thereof, which is opposite to the piston (30), coupled to a rod base (41), which is axially spaced from the cylinder (20) and coupled to the housing (10) through the second supporting means (80).

3. A reciprocating compressor, as in claim 2, characterized in that the rod base (41) is in the form of a tubular block, which is coaxial to the cylinder (20) and surrounds said opposite end of the rod (40).

4. A reciprocating compressor, as in claim 2, characterized in that the second annular motor portion (52) is coupled externally to the rod base (41).

5. A reciprocating compressor, as in claim 2, characterized in that the rod base (41) is further coupled to the housing (10) through a third supporting means (90) having the same construction of the second supporting means (80).

6. A reciprocating compressor, as in claim 1, characterized in that the first annular motor portion (51) and the second annular motor portion (52) are axially aligned to each other and maintain a mutual axial spacing, ranging between a maximum value, corresponding to the lower dead point position of the piston (30), and a minimum value, corresponding to the upper dead point position of the piston (30).

7. A reciprocating compressor, as in claim 1, characterized in that the cylinder (20) has the end thereof, which is opposite to the rod (40), closed by a valve plate (60), to which external face is affixed a cylinder cover (65).

8. A reciprocating compressor, as in claim 7, characterized in that the cylinder cover (65) is coupled to the housing (10) by a fourth supporting means (100) with the same construction of the first supporting means (70).

9. A reciprocating compressor, as in claim 1, characterized in that one of the supporting means (70, 80) comprises an external portion (71, 81), which is internally coupled to the housing (10), and an internal portion (72, 82) which is coupled to the cylinder (20) and to the rod (40), respectively, and an intermediate portion **(73, 73*a*, 83), which is elastically deformable and which interconnects the external portion (71, 81) and the internal portion (72, 82) of each supporting means (70, 80)**.

10. A reciprocating compressor, as in claim 9, characterized in that each supporting means (70, 80) comprises a blade, which is transversal to the longitudinal axis of the cylinder (20) and which has the external portion (71, 81) and internal portion (72, 82) with an annular shape and the intermediate portion **(73, 73*a*, 83)** defined by a plurality of radial arms interconnecting the external and internal portions.

11. A reciprocating compressor, as in claim 10, characterized in that the first supporting means (70) and the second supporting means (80) have their external portions (71, 81) coupled to rigid longitudinal bars (110), whose opposite ends are affixed to the housing (10).

12. A reciprocating compressor, as in claim 11, characterized in that the rigid longitudinal bars (110) are affixed to the housing (10) through rubber pads (120).

13. A reciprocating compressor, as in claim 1, characterized in that the first supporting means (70) and the second supporting means (80) are elastically deformable, so that to allow the cylinder (20) and the piston-rod assembly (30, 40) to be axially displaced, in opposite directions, by an extension corresponding, at minimum, to half the total displacement of the piston (30) from the lower dead point position of said piston.

14. A reciprocating compressor, as in claim 1, characterized in that the rod (40) has the ends thereof respectively affixed to the piston (30) and to the second supporting means (80) and has a length/diameter relationship sufficiently high to provide the rod (40) with a radial flexibility capable of absorbing possible disalignments between the axis thereof and that of the cylinder, upon movement of said parts, without occurring excessive bending.

* * * * *